US009263225B2

(12) United States Patent
Morton et al.

(10) Patent No.: US 9,263,225 B2
(45) **Date of Patent: *Feb. 16, 2016**

(54) X-RAY TUBE ANODE COMPRISING A COOLANT TUBE

(75) Inventors: Edward James Morton, Guildford (GB); Russell David Luggar, Dorking (GB); Martin Hunt, Southampton (GB)

(73) Assignee: Rapiscan Systems, Inc., Torrance, CA (US)

( * ) Notice: Subject to any disclaimer, the term of this patent is extended or adjusted under 35 U.S.C. 154(b) by 678 days.

This patent is subject to a terminal disclaimer.

(21) Appl. No.: 13/054,066

(22) PCT Filed: Jul. 15, 2009

(86) PCT No.: PCT/GB2009/001760

§ 371 (c)(1), (2), (4) Date: Oct. 5, 2011

(87) PCT Pub. No.: WO2010/007375

PCT Pub. Date: Jan. 21, 2010

(65) Prior Publication Data

US 2012/0014510 A1 Jan. 19, 2012

(30) Foreign Application Priority Data

Jul. 15, 2008 (GB) ..... 0812864.7

(51) Int. Cl.
*H01J 35/12* (2006.01)
*H01J 35/08* (2006.01)

(52) U.S. Cl.
CPC ..... *H01J 35/12* (2013.01); *H01J 35/08* (2013.01); *H01J 2235/081* (2013.01); *H01J 2235/083* (2013.01); *H01J 2235/086* (2013.01); *H01J 2235/1204* (2013.01); *H01J 2235/1262* (2013.01)

(58) Field of Classification Search
CPC ..... H01J 2235/1204; H01J 2235/1262; H01J 35/105; H01J 35/106; H01J 35/12; H01J 2235/081; H01J 2235/083; H01J 2235/086; H01J 35/08
USPC ..... 378/127, 128, 130, 141, 142, 199, 200, 378/143
See application file for complete search history.

(56) References Cited

U.S. PATENT DOCUMENTS 2,101,143 A 12/1937 Laidig
2,333,525 A 11/1943 Cox
(Continued)

FOREIGN PATENT DOCUMENTS

CN 1138743 A 12/1996
CN 1172952 A 2/1998
(Continued)

OTHER PUBLICATIONS

Search Report PCT/GB2009/001760, Jan. 21, 2010, Morton et al.
(Continued)

*Primary Examiner* — Allen C. Ho
(74) *Attorney, Agent, or Firm* — Novel IP

(57) ABSTRACT

An anode for an X-ray tube includes at least one thermally conductive anode segment in contact with a rigid support member and cooling means arranged to cool the anode. The anode may further include a plurality of anode segments aligned end to end, each in contact with the support member.

16 Claims, 3 Drawing Sheets

(56) References Cited

U.S. PATENT DOCUMENTS 2,842,694 A 7/1958 Hosemann
2,952,790 A 9/1960 Steen
3,138,729 A 6/1964 Henke
3,239,706 A 3/1966 Farrell
3,768,645 A 10/1973 Conway
3,867,637 A * 2/1975 Braun et al. ..... 378/2
4,045,672 A 8/1977 Watanabe
4,057,725 A 11/1977 Wagner
4,064,411 A * 12/1977 Iwasaki et al. ..... 378/141
4,105,922 A 8/1978 Lambert
4,165,472 A * 8/1979 Wittry ..... 378/127
4,171,254 A 10/1979 Koenecke
4,228,353 A 10/1980 Johnson
4,238,706 A * 12/1980 Yoshihara et al. ..... 378/34
4,241,404 A 12/1980 Lux
4,259,721 A 3/1981 Kuznia
4,266,425 A 5/1981 Allport
4,274,005 A 6/1981 Yamamura
4,309,637 A 1/1982 Fetter
4,340,816 A 7/1982 Schott
4,344,011 A 8/1982 Hayashi
4,352,021 A 9/1982 Boyd
4,352,196 A 9/1982 Gabbay
4,405,876 A * 9/1983 Iversen ..... 313/30
4,420,382 A 12/1983 Riedl
4,461,020 A * 7/1984 Hubner et al. ..... 378/143
4,468,802 A 8/1984 Friedel
4,531,226 A 7/1985 Peschmann
4,622,687 A * 11/1986 Whitaker et al. ..... 378/130
4,625,324 A 11/1986 Blaskis
4,670,895 A * 6/1987 Penato et al. ..... 378/125
4,672,649 A 6/1987 Rutt
4,675,890 A 6/1987 Plessis
4,677,651 A 6/1987 Hartl
4,719,645 A 1/1988 Yamabe et al.
4,736,400 A * 4/1988 Koller et al. ..... 378/125
4,763,345 A 8/1988 Barbaric
RE32,961 E 6/1989 Wagner
4,866,745 A 9/1989 Akai
4,868,856 A 9/1989 Frith
4,887,604 A 12/1989 Shefer
4,894,775 A 1/1990 Kritchman
4,928,296 A * 5/1990 Kadambi ..... 378/141
4,945,562 A * 7/1990 Staub ..... 378/130
4,991,194 A * 2/1991 Laurent et al. ..... 378/144
5,018,181 A * 5/1991 Iversen et al. ..... 378/144
5,033,106 A 7/1991 Kita
5,056,127 A * 10/1991 Iversen et al. ..... 378/130
5,065,418 A 11/1991 Bermbach
5,068,882 A 11/1991 Eberhard
5,073,910 A 12/1991 Eberhard
5,091,924 A 2/1992 Bermbach
5,091,927 A 2/1992 Golitzer
5,159,234 A 10/1992 Wegmann
5,191,600 A 3/1993 Vincent
5,195,112 A 3/1993 Vincent
5,247,556 A 9/1993 Eckert
5,259,014 A 11/1993 Brettschneider
5,268,955 A 12/1993 Burke
5,272,627 A 12/1993 Maschhoff
5,305,363 A 4/1994 Burke
5,313,511 A 5/1994 Annis
5,329,180 A 7/1994 Popli
5,367,552 A 11/1994 Peschmann
5,375,156 A 12/1994 Kuo-Petravic
5,414,622 A 5/1995 Walters
5,467,377 A 11/1995 Dawson
5,511,104 A 4/1996 Mueller
5,515,414 A * 5/1996 d'Achard Van Enschut et al. ..... 378/141
5,541,975 A 7/1996 Anderson
5,568,829 A 10/1996 Crawford
5,596,621 A 1/1997 Schwarz
5,600,700 A 2/1997 Krug
5,604,778 A 2/1997 Polacin
5,633,907 A 5/1997 Gravelle
5,654,995 A 8/1997 Flohr
5,680,432 A 10/1997 Voss
5,689,541 A 11/1997 Schardt
5,712,889 A 1/1998 Lanzara
5,798,972 A 8/1998 Lao
5,841,831 A 11/1998 Hell
5,859,891 A 1/1999 Hibbard
5,879,807 A 3/1999 Inoue
5,889,833 A 3/1999 Silver
5,907,593 A 5/1999 Hsieh
5,966,422 A 10/1999 Dafni
5,974,111 A 10/1999 Krug
5,987,097 A 11/1999 Salasoo
6,014,419 A 1/2000 Hu
6,018,562 A 1/2000 Willson
6,075,836 A 6/2000 Ning
6,088,426 A * 7/2000 Miller ..... 378/144
6,108,575 A 8/2000 Besson
6,122,343 A 9/2000 Pidcock
6,130,502 A 10/2000 Kobayashi
6,181,765 B1 1/2001 Sribar
6,183,139 B1 2/2001 Solomon
6,188,747 B1 2/2001 Geus
6,218,943 B1 4/2001 Ellenbogen
6,229,870 B1 5/2001 Morgan
6,236,709 B1 5/2001 Perry
6,240,157 B1 5/2001 Danielsson
6,269,142 B1 7/2001 Smith
6,298,110 B1 10/2001 Ning
6,324,243 B1 11/2001 Edic
6,324,249 B1 11/2001 Fazzio
6,341,154 B1 1/2002 Besson
6,404,230 B1 6/2002 Cairns
6,430,260 B1 * 8/2002 Snyder ..... 378/130
6,449,331 B1 9/2002 Nutt
6,470,065 B1 10/2002 Lauther
6,480,571 B1 * 11/2002 Andrews ..... 378/131
6,546,072 B1 4/2003 Chalmers
6,553,096 B1 4/2003 Zhou
6,556,653 B2 4/2003 Chalmers
6,580,780 B1 6/2003 Miller
6,624,425 B2 9/2003 Nisius
6,674,838 B1 1/2004 Barrett
6,721,387 B1 4/2004 Naidu
6,751,293 B1 * 6/2004 Barrett ..... 378/144
6,760,407 B2 7/2004 Price et al.
6,785,359 B2 8/2004 Lemaitre
6,819,742 B1 * 11/2004 Miller ..... 378/144
6,975,703 B2 12/2005 Wilson et al.
6,993,115 B2 1/2006 McGuire et al.
7,079,624 B1 7/2006 Miller
7,184,520 B1 * 2/2007 Sano ..... 378/125
7,192,031 B2 3/2007 Ying
7,197,116 B2 3/2007 Dunham
7,203,269 B2 4/2007 Huber
7,203,282 B2 * 4/2007 Brauss ..... B01D 29/03 378/141
7,218,700 B2 5/2007 Huber et al.
7,233,644 B1 6/2007 Bendahan
7,248,673 B2 * 7/2007 Miller ..... 378/144
7,349,525 B2 * 3/2008 Morton et al. ..... 378/124
7,466,799 B2 12/2008 Miller
7,508,916 B2 * 3/2009 Frontera ..... H01J 35/101 378/130
7,664,230 B2 2/2010 Morton
7,697,665 B2 * 4/2010 Yonezawa ..... H01J 35/106 378/130
7,728,397 B2 6/2010 Gorrell
7,738,632 B2 * 6/2010 Popescu ..... A61B 6/032 378/124
8,094,784 B2 * 1/2012 Morton ..... 378/124
8,243,876 B2 8/2012 Morton
8,331,535 B2 12/2012 Morton
8,654,924 B2 2/2014 Behling
2001/0033635 A1 10/2001 Kuwabara
2002/0031202 A1 3/2002 Callerame
2002/0082492 A1 6/2002 Grzeszczuk
2002/0094064 A1 7/2002 Zhou

(56) References Cited

U.S. PATENT DOCUMENTS

| | | | |
|---|---|---|---|
| 2002/0097836 | A1 | 7/2002 | Grodzins |
| 2002/0140336 | A1 | 10/2002 | Stoner |
| 2002/0176531 | A1 | 11/2002 | McClelland |
| 2003/0021377 | A1 | 1/2003 | Turner et al. |
| 2003/0031352 | A1 | 1/2003 | Turner |
| 2003/0043957 | A1 | 3/2003 | Pelc |
| 2003/0048868 | A1 | 3/2003 | Bailey |
| 2003/0076921 | A1 | 4/2003 | Mihara |
| 2003/0076924 | A1 | 4/2003 | Mario |
| 2003/0091148 | A1 | 5/2003 | Bittner |
| 2004/0120454 | A1 | 1/2004 | Seppi |
| 2004/0022292 | A1 | 2/2004 | Morton |
| 2004/0057554 | A1 | 3/2004 | Bjorkholm |
| 2004/0066879 | A1 | 4/2004 | Machida |
| 2004/0094064 | A1 | 5/2004 | Taguchi |
| 2004/0202282 | A1 | 10/2004 | Miller |
| 2004/0213378 | A1 | 10/2004 | Zhou et al. |
| 2004/0252807 | A1 | 12/2004 | Skatter |
| 2004/0258305 | A1 | 12/2004 | Burnham |
| 2005/0002492 | A1 | 1/2005 | Rother |
| 2005/0031075 | A1 | 2/2005 | Hopkins |
| 2005/0053189 | A1 | 3/2005 | Gohno |
| 2005/0058242 | A1 | 3/2005 | Peschmann |
| 2005/0100135 | A1 | 5/2005 | Lowman |
| 2005/0105682 | A1 | 5/2005 | Heumann |
| 2005/0111610 | A1 | 5/2005 | Heumann |
| 2005/0123092 | A1 | 6/2005 | Mistretta |
| 2005/0157925 | A1 | 7/2005 | Lorenz |
| 2005/0175151 | A1 | 8/2005 | Dunham |
| 2005/0276377 | A1 | 12/2005 | Carol |
| 2005/0276382 | A1 | 12/2005 | Lesiak |
| 2006/0050842 | A1 | 3/2006 | Wang |
| 2006/0233297 | A1 | 10/2006 | Ishiyama |
| 2007/0053495 | A1 | 1/2007 | Seppi |
| 2007/0064873 | A1 | 3/2007 | Gabioud |
| 2007/0172023 | A1 | 7/2007 | Morton |
| 2007/0183575 | A1 | 8/2007 | Lemaitre |
| 2007/0297570 | A1 | 12/2007 | Kerpershoek |
| 2008/0019483 | A1 | 1/2008 | Andrews |
| 2008/0043920 | A1 | 2/2008 | Liu |
| 2008/0056436 | A1 | 3/2008 | Pack |
| 2008/0056437 | A1 | 3/2008 | Pack |
| 2008/0112540 | A1 | 5/2008 | Rogers |
| 2008/0123803 | A1 | 5/2008 | DeMan |
| 2008/0130974 | A1 | 6/2008 | Xu |
| 2009/0022264 | A1 | 1/2009 | Zhou |
| 2009/0097836 | A1 | 4/2009 | Tanaka |
| 2009/0159451 | A1 | 6/2009 | Tomantschger |
| 2009/0185660 | A1 | 7/2009 | Zou |
| 2010/0046716 | A1 | 2/2010 | Freudenberger |
| 2001/0022346 | A1 | 3/2010 | Morton |
| 2010/0111265 | A1 | 5/2010 | Holm |
| 2010/0246754 | A1 | 9/2010 | Morton |
| 2010/0316192 | A1 | 12/2010 | Hauttmann |
| 2011/0188725 | A1 | 8/2011 | Yu |
| 2011/0222662 | A1 | 9/2011 | Behling |
| 2013/0156161 | A1 | 6/2013 | Andrews |
| 2013/0195253 | A1 | 8/2013 | Andrews |

FOREIGN PATENT DOCUMENTS

| | | | |
|---|---|---|---|
| CN | 1194718 | | 9/1998 |
| CN | 1795527 | A | 6/2006 |
| DE | 2729353 | A1 | 1/1979 |
| DE | 3638378 | | 5/1988 |
| DE | 3840398 | A1 | 6/1989 |
| DE | 4432205 | C1 | 1/1996 |
| DE | 4425691 | A1 | 2/1996 |
| DE | 19745998 | A1 | 3/1999 |
| DE | 10036210 | A1 | 11/2001 |
| DE | 10319547 | | 11/2004 |
| DE | 10319549 | B3 | 12/2004 |
| EP | 0142249 | A2 | 5/1985 |
| EP | 0432568 | | 6/1991 |
| EP | 03198975 | | 8/1991 |
| EP | 0531993 | A1 | 3/1993 |
| EP | 05135721 | | 6/1993 |
| EP | 05182617 | | 7/1993 |
| EP | 05290768 | | 11/1993 |
| EP | 0584871 | A1 | 3/1994 |
| EP | 0924742 | A2 | 6/1999 |
| EP | 0930046 | A2 | 7/1999 |
| EP | 1277439 | A1 | 1/2003 |
| EP | 1374776 | A1 | 1/2004 |
| EP | 1558142 | A1 | 8/2005 |
| FR | 2328280 | A1 | 5/1977 |
| FR | 2675629 | A1 | 10/1992 |
| GB | 1149796 | A | 4/1969 |
| GB | 1272498 | | 4/1972 |
| GB | 1497396 | A | 1/1978 |
| GB | 1526041 | A | 9/1978 |
| GB | 2015245 | A | 9/1979 |
| GB | 2089109 | A | 6/1982 |
| GB | 2212903 | A | 8/1989 |
| GB | 2212975 | A | 8/1989 |
| GB | 2360405 | A | 9/2001 |
| GB | 2418529 | A | 3/2006 |
| JP | 50081080 | A | 7/1975 |
| JP | S51055286 | | 5/1976 |
| JP | S51078696 | | 7/1976 |
| JP | S52050186 | | 4/1977 |
| JP | S52124890 | | 10/1977 |
| JP | 5493993 | | 7/1979 |
| JP | S55046408 | | 4/1980 |
| JP | 56086448 | | 7/1981 |
| JP | S56167464 | | 12/1981 |
| JP | 5717524 | A | 1/1982 |
| JP | S57110854 | | 7/1982 |
| JP | 570175247 | | 10/1982 |
| JP | S57175247 | A | 10/1982 |
| JP | 58212045 | A | 12/1983 |
| JP | 590016254 | A | 1/1984 |
| JP | S591625 | A | 1/1984 |
| JP | S5916254 | A | 1/1984 |
| JP | 59075549 | | 4/1984 |
| JP | S5975549 | A | 4/1984 |
| JP | 600015546 | | 1/1985 |
| JP | S601554 | A | 1/1985 |
| JP | S602144 | | 1/1985 |
| JP | 600021440 | | 2/1985 |
| JP | S6038957 | A | 2/1985 |
| JP | S60181851 | | 12/1985 |
| JP | 61107642 | | 5/1986 |
| JP | 62044940 | A | 2/1987 |
| JP | S62121773 | | 8/1987 |
| JP | 63016535 | | 1/1988 |
| JP | 1296544 | A | 11/1989 |
| JP | 3198975 | | 8/1991 |
| JP | H0479128 | A | 3/1992 |
| JP | H04319237 | | 11/1992 |
| JP | 5135721 | | 6/1993 |
| JP | 5182617 | | 7/1993 |
| JP | 5290768 | | 11/1993 |
| JP | 060038957 | | 2/1994 |
| JP | H0638957 | A | 2/1994 |
| JP | 06162974 | | 6/1994 |
| JP | H06261895 | | 9/1994 |
| JP | H07093525 | | 4/1995 |
| JP | H09171788 | | 6/1997 |
| JP | H10211196 | A | 8/1998 |
| JP | H10272128 | | 10/1998 |
| JP | H11500229 | | 1/1999 |
| JP | H11273597 | | 10/1999 |
| JP | 2000175895 | | 6/2000 |
| JP | 2001023557 | | 1/2001 |
| JP | 2001502473 | | 2/2001 |
| JP | 2001176408 | A | 6/2001 |
| JP | 2001204723 | | 7/2001 |
| JP | 2002343291 | | 11/2002 |
| JP | 2003092076 | | 3/2003 |
| JP | 2003121392 | | 4/2003 |
| JP | 2003126075 | A | 5/2003 |
| JP | 2003257347 | | 9/2003 |

(56) References Cited

FOREIGN PATENT DOCUMENTS

| | | | |
|---|---|---|---|
| JP | 2004000605 | A | 1/2004 |
| JP | 2004079128 | A | 3/2004 |
| JP | 2004311245 | | 11/2004 |
| JP | 2005013768 | A | 1/2005 |
| JP | 2006128137 | | 5/2006 |
| JP | 2006351272 | A | 12/2006 |
| JP | 2007265981 | | 10/2007 |
| JP | 2008166059 | A | 7/2008 |
| JP | 100211196 | | 9/2010 |
| SU | 1022236 | A1 | 6/1983 |
| WO | 9528715 | A2 | 10/1995 |
| WO | 9718462 | A1 | 5/1997 |
| WO | 9960387 | A2 | 11/1999 |
| WO | 0231857 | | 4/2002 |
| WO | 03051201 | A2 | 6/2003 |
| WO | 2004010127 | | 1/2004 |
| WO | 2004042769 | A1 | 5/2004 |
| WO | 2004097386 | A1 | 11/2004 |
| WO | 2004097889 | A2 | 11/2004 |
| WO | WO 2004097888 | | 11/2004 |
| WO | 2006130630 | A2 | 12/2006 |
| WO | 2007068933 | | 6/2007 |
| WO | 2008068691 | | 6/2008 |
| WO | 2009012453 | A1 | 1/2009 |
| WO | 2010007375 | A2 | 1/2010 |
| WO | 2010086653 | | 8/2010 |
| WO | 2010141659 | A1 | 12/2010 |

OTHER PUBLICATIONS

International Search Report, PCT/GB2004/001729, Aug. 12, 2004, Rapiscan Systems, Inc.
International Search Report, PCT/GB2004/001732, Feb. 25, 2005.
International Search Report for PCT/US2010/037167, Sep. 7, 2010.
Office Action dated Oct. 21, 2014 for U.S. Appl. No. 13/674,086.
Second office action for Japanese Application No. JP2012-514109 mailed on Oct. 20, 2014.
International Search Report, PCT/US2010/41871, Jan. 20, 2011, Rapiscan Systems, Inc.
Notice of Allowance dated Jan. 30, 2015 for U.S. Appl. No. 13/405,117.
Bruder et al. "Efficient Extended Field of View (eFOV) Reconstructuion Techniques for Multi-Slice Helical CT", Medical Imaging 2008: Physics of Medical Imaging, edited by Jiang Hsieh, Ehsan Samei, Proc. of SPIE vol. 6913, 69132E, (2008).
Chinese Patent Application No. 200980114807.X, Second Office Action, Nov. 21, 2013.
Great Britain Patent Application No. GB0816823.9, Search Report, Oct. 20, 2009.
Great Britain Patent Application No. GB1104148.0, Examination Report, Mar. 29, 2011.
International Search Report, PCT/GB2004/001741, Mar. 3, 2005.
International Search Report, PCT/GB2004/001731, May 27, 2005.
International Search Report, PCT/GB2004/001751, Mar. 21, 2005.
STMicroelectronics, "Dual Full-Bridge Driver", Datasheet for L298, 2000, pp. 1-13, XP002593095.
Notice of Allowance dated Dec. 4, 2014 for U.S. Appl. No. 13/313,854.
Office Action dated Nov. 26, 2014 for U.S. Appl. No. 13/146,645.
Supplementary European Search Report, EP10784058, Dec. 6, 2013.
European Search Opinion, EP10784058, Dec. 18, 2013.
International Search Report, PCT/GB2004/001747, Aug. 10, 2004.
US 5,987,079, 11/1999, Scott (withdrawn)

* cited by examiner

X-RAY TUBE ANODE COMPRISING A COOLANT TUBE

CROSS-REFERENCE TO RELATED APPLICATIONS

The present application is a national stage application of PCT/GB2009/001760, filed on Jul. 15, 2009. The present application further relies on Great Britain Patent Application Number 0812864.7, filed on Jul. 15, 2008, for priority. Both priority applications are herein incorporated by reference in their entirety.

FIELD OF THE INVENTION

The present invention relates to X-ray tubes and in particular to the cooling of the anode of an X-ray tube.

BACKGROUND OF THE INVENTION

It is well known to provide an X-ray tube comprising an electron source and a metal anode, wherein the anode is at a positive potential with respect to the electron source. The electric field accelerates the emitted electron towards the anode. When they strike the anode they lose some, or all, of their kinetic energy, the majority of which is released as heat. This heat can reduce the target lifetime and it is therefore common to cool the anode. Conventional methods include air cooling, wherein the anode is typically operated at ground potential with heat conduction to ambient through an air cooled heatsink, and a rotating anode, wherein the irradiated point is able to cool as it rotates around before being irradiated once more.

In some circumstances a moving X-ray source is required, which is generated by scanning an electron beam along an arcuate or linear anode. These anodes may extend to a length of several meters and it is generally complex and expensive to fabricate a single piece anode.

SUMMARY OF THE INVENTION

Accordingly, a first aspect of the invention provides an anode for an X-ray tube comprising at least one thermally conductive anode segment in contact with a rigid support member and cooling means arranged to cool the anode.

Preferably, the cooling means comprises a cooling conduit arranged to carry coolant through the anode. This conduit may comprise a coolant tube housed within a cooling channel, which may be defined by the anode segment and the support member.

Preferably, the anode comprises a plurality of anode segments aligned end to end. This enables an anode to be built of a greater length than would easily be achieved using a single piece anode. Each anode segment may be coated with a thin film. The thin film may coat at least an exposed surface of the anode segment and may comprise a target metal. For example, the film may be a film of any one of tungsten, molybdenum, uranium and silver. Application of the metal film onto the surface of the anode may be by any one of sputter coating, electro deposition and chemical deposition. Alternatively, a thin metal foil may be brazed onto the anode segment. The thin film may have a thickness of between 30 microns and 1000 microns, preferably between 50 microns and 500 microns.

Preferably, the anode segments are formed from a material with a high thermal conductivity such as copper. The rigid backbone may preferably be formed from stainless steel. The excellent thermal matching of copper and stainless steel means that large anode segments may be fabricated with little distortion under thermal cycling and with good mechanical stability.

The plurality of anode segments may be bolted onto the rigid backbone. Alternatively, the rigid backbone may be crimped into the anode segments using a mechanical press. Crimping, in particular if used as the sole means of attaching the anode segments to the backbone, reduces the number of mechanical processes required and removes the need for bolts, which introduce the risk of gas being trapped at the base of the bolts.

The integral cooling channel may extend along the length of the backbone and may either be cut into the anode segments or into the backbone. Alternatively, the channel may be formed from aligned grooves cut into both the anode segments and the backbone. A cooling tube may extend along the cooling channel and may contain cooling fluid. Preferably, the tube is an annealed copper tube. The cooling channel may have a square or rectangular cross section or, alternatively, may have a semi-circular or substantially circular cross section. A rounded cooling channel allows better contact between the cooling tube and the anode and therefore provides more efficient cooling.

The cooling fluid may be passed into the anode through an insulated pipe section. The insulated pipe section may comprise two ceramic tubes with brazed end caps, connected at one end to a stainless steel plate. This stainless steel plate may have two ports formed through it, and each of the insulated pipe sections may be aligned with one of the ports. The plate may be mounted into the X-ray tube vacuum housing. The ceramic tubes may be connected to the cooling channel by two right-angle pipe joints and may be embedded within the anode.

BRIEF DECRIPTION OF THE DRAWINGS

An embodiment of the present invention will now be described, by way of example only, with reference to the accompanying drawings in which:

FIG. 1*a* is a sectioned perspective view of an anode according to an embodiment of the invention;

FIG. 1*b* is a sectioned perspective view of an anode according to a further embodiment of the invention;

DETAILED DECRIPTION OF THE INVENTION

Figure 1A:
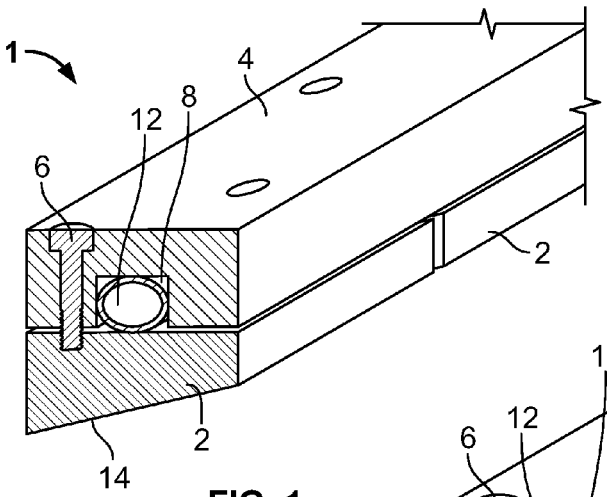

Referring to FIG. 1*a*, an anode 1 according to one embodiment of the invention comprises a plurality of thermally conductive anode segments 2 bolted to a rigid single piece support member in the form of a backbone 4 by bolts 6. A cooling channel 8, 10 extends along the length of the anode 1 between the thermally conductive anode segments 2 and the backbone 4 and contains a coolant conduit in the form of a coolant tube 12 arranged to carry the cooling fluid.

The anode segments 2 are formed from a metal such as copper and are held at a high voltage positive electrical potential with respect to an electron source. Each anode segment 2 has an angled front face 14, which is coated with a suitable target metal such as molybdenum, tungsten, silver or uranium selected to produce the required X-rays when electrons are incident upon it. This layer of target metal is applied to the front face 14 using one of a number of methods including sputter coating, electro-deposition, chemical vapour deposition and flame spray coating. Alternatively, a thin metal foil with a thickness of 50-500 microns is brazed onto the copper anode front face 14.

Referring to FIG. 1*a*, the cooling channel 8 is formed in the front face of the rigid backbone 4 and extends along the length of the anode 1. The cooling channel 8 has a square or rectangular cross-section and contains an annealed copper coolant tube 12, which is in contact with both the copper anode segments 2, the flat rear face of which forms the front side of the cooling channel 8, and the backbone 4. A cooling fluid such as oil is pumped through the coolant tube 12 to remove heat from the anode 1.

Figure 1B:
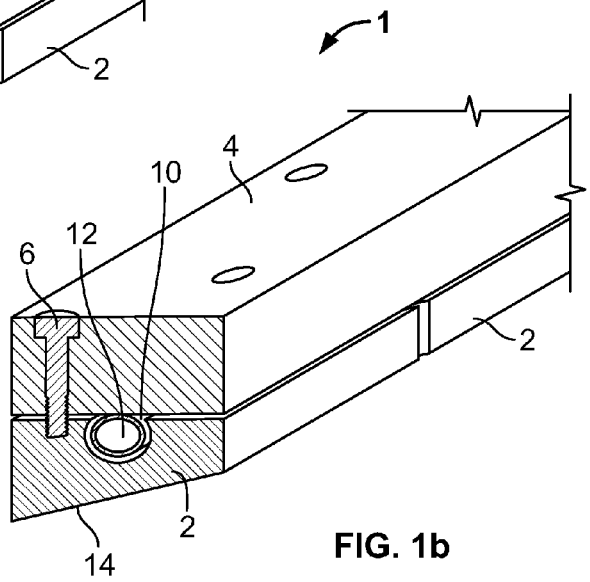

FIG. 1*b* shows an alternative embodiment in which the cooling channel 10 is cut into the plurality of anode segments 2. The cooling channel 10 has a semi-circular cross section with a flat rear surface of the cooling channel 10 being provided by the backbone 4. The semi-circular cross-section provides better contact between the coolant tube 12 and the anode segments 2, therefore improving the efficiency of heat removal from the anode 1. Alternatively, the cooling channel 10 may comprise two semi-circular recesses in both the backbone 4 and the anode segments 2, forming a cooling channel 10 with a substantially circular cross-section.

The rigid single piece backbone 4 is formed from stainless steel and can be made using mechanically accurate and inexpensive processes such as laser cutting while the smaller copper anode segments 2 are typically fabricated using automated machining processes. The backbone 4 is formed with a flat front face and the anode segments 2 are formed with flat rear faces, which are in contact with and held against the front face of the backbone 4, so as to ensure good thermal contact between them when these flat faces are in contact. Due to the excellent thermal matching of copper and stainless steel and the good vacuum properties of both materials, large anode segments 2 may be fabricated with little distortion under thermal cycling and with good mechanical stability.

The bolts 6 fixing the anode segments 2 onto the backbone 4 pass through bores that extend from a rear face of the backbone, through the backbone 4 to its front face, and into threaded blind bores in the anode segments 2. During the assembly of the anode 1, there is the potential for gas pockets to be trapped around the base of these bolts 6. Small holes or slots may therefore be cut into the backbone 4 or anode 1 to connect these blind bores to the outer surface of the backbone 4 or anode 1, allowing escape of the trapped pockets of gas.

Bolting a number of anode segments 2 onto a single backbone 4, as shown in FIGS. 1*a* and 1*b*, enables an anode to be built that extends for several meters. This would otherwise generally be expensive and complicated to achieve.

Figure 2:
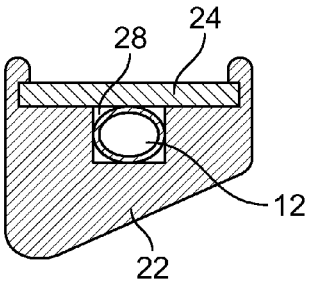
FIG. 2 is a section through an anode segment crimped to a backbone according to a further embodiment of the invention.

FIG. 2 shows an alternative design in which a single piece rigid backbone 24 in the form of a flat plate is crimped into the anode segments 22 using a mechanical press. A square cut cooling channel 28 is cut into the back surface of the anode segments 22 and extends along the length of the anode 1, being covered by the backbone 24. Coolant fluid is passed through an annealed copper coolant tube 12, which is located inside the cooling channel 28, to remove heat generated in the anode 1. This design reduces the machining processes required in the anode 1 and also removes the need for bolts 6 and the associated potential trapped gas volumes at the base of the bolts 6.

Figure 3:
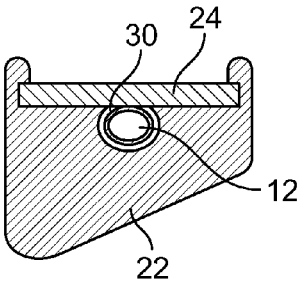
FIG. 3 is a section through an anode according to a further embodiment of the invention a round-ended cooling channel.

FIG. 3 shows a similar design of anode 1 to that shown in FIG. 2, wherein a rigid backbone 24 is crimped into anode segments 22. In this embodiment, a cooling channel 30 of curved cross-section, in this case semi-elliptical, extends along the length of the anode 1 and is cut into the anode segments 22 with a round-ended tool. A coolant tube 12 is located inside the cooling channel 30 and is filled with a cooling fluid such as oil. The rounded cooling channel 30 provides superior contact between the coolant tube 12, which is of a rounded shape to fit in the cooling channel 30, and the anode segments 22.

Figure 4:
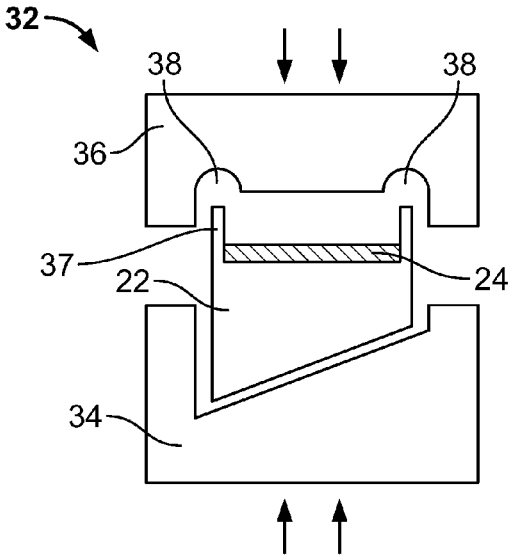
FIG. 4 shows a crimping tool used to crimp an anode segment to a backbone.

Referring to FIG. 4, the anode 1 of FIGS. 2 and 3 is formed using a crimp tool 32. The coated copper anode segments 22 are supported in a base support 34 with walls 37 projecting upwards from the sides of the rear face of the anode segments 22. The rigid backbone 24 is placed onto the anode segments 22, fitting between the projecting anode walls 37. An upper part 36 of the crimp tool 32 has grooves 38 of a rounded cross section formed in it arranged to bend over and deform the straight copper walls 37 of the anode segments 22 against the rear face of the backbone as it is lowered towards the base support 34, crimping the backbone 24 onto the anode segments 22. Typically a force of about 0.3 - 0.7 tonne/cm length of anode segments 22 is required to complete the crimping process. As a result of the crimping process the crimped edges of the anode segments 22 form a continuous rounded ridge along each side of the backbone 24. It will be appreciated that other crimping arrangements could be used, for example the anode segments 22 could be crimped into grooves in the sides of the backbone 24, or the backbone 24 could be crimped into engagement with the anode 1.

In use, the anode segments 22 are held at a relatively high electrical potential. Any sharp points on the anode 1 can therefore lead to a localised high build up of electrostatic charge and result in electrostatic discharge. Crimping the straight copper walls 37 of the anode segments 22 around the backbone 24 provides the anode segments 22 with rounded edges and avoids the need for fasteners such as bolts 6. This helps to ensure an even distribution of charge over the anode 1 and reduces the likelihood of electrostatic discharge from the anode 1.

Figure 5:
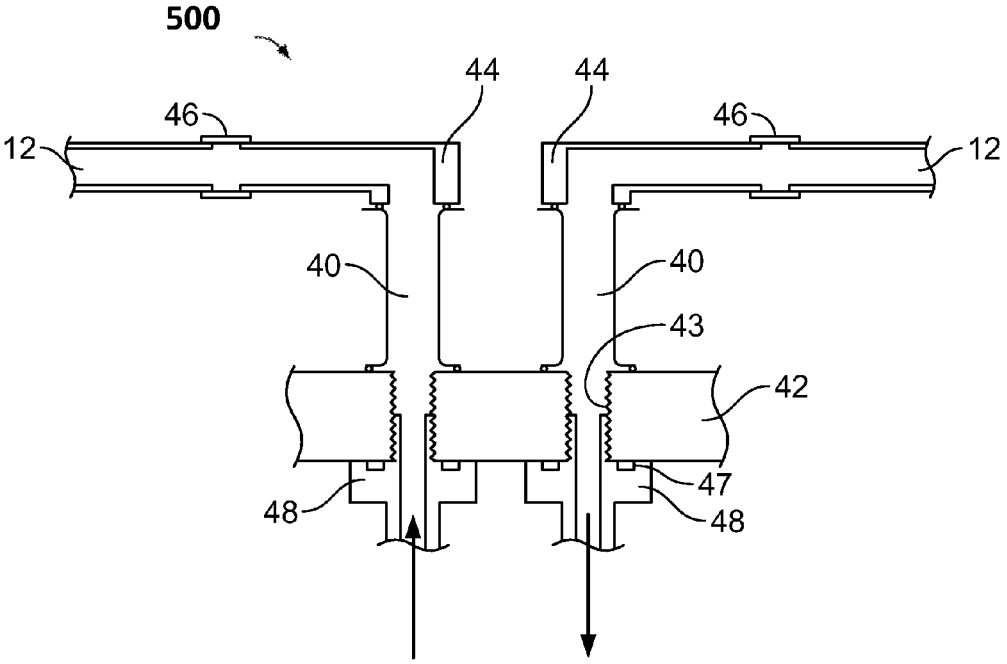
FIG. 5 shows a connection arrangement for the coolant tube of the anode of FIG. 1.

To pass the coolant fluid into the anode 1 it is often necessary to use an electrically insulated pipe section, or assembly, 500, since the anode 1 is often operated at positive high voltage with respect to ground potential. Non-conducting, in this case ceramic breaks, 40 may be used to provide an electrically isolated connection between the coolant tubes 12 and an external supply of coolant fluid. The coolant fluid is pumped through the ceramic tubes into the coolant tube 12, removing the heat generated as X-rays are produced. FIG. 5 shows an insulated pipe section comprising two ceramic breaks 40 (ceramic tubes with brazed end caps) welded at a first end to a stainless steel plate 42. The plate 42 has ports 43 formed through it, and the end of each of the ceramic breaks 40 is located over a respective one of these ports 43. The stainless steel plate 42 is then mounted into the X-ray tube vacuum housing. Two right-angle pipe sections 44 are each welded at one end to a second end of one of the ceramic breaks 40. The other ends of the right-angle pipe sections 44 are then brazed to the coolant tube 12, which extends along the cooling channel 8, 10 of the anode 1. A localized heating method is used such as induction brazing using a copper collar 46 around the coolant tube 12 and right angle pipe sections 44. Threaded connectors 48 are screwed into the ports 43, which are threaded towards their outer ends. These threaded connectors 48 on the external side of the stainless steel plate 42 attach the insulated pipe section 500 to external coolant circuits. These threaded connectors 48 may be welded to the assembly 500 or screwed in using O-ring seals 47, for example.

In order to maximize the electrostatic performance of the anode 1, it is advantageous to embed the high voltage right-angle pipe sections 44 of the coolant assembly, such as those shown in FIG. 5, within the anode 1 itself. Following connection of the insulated pipe section 500 to the coolant tube 12 it may not be possible to crimp the backbone 24 in the anode segments 22, as shown in FIGS. 2 and 3. In this case, a mechanical fixing such as the bolts 6 shown in FIGS. 1*a* and 1*b* are used.

Figure 6:
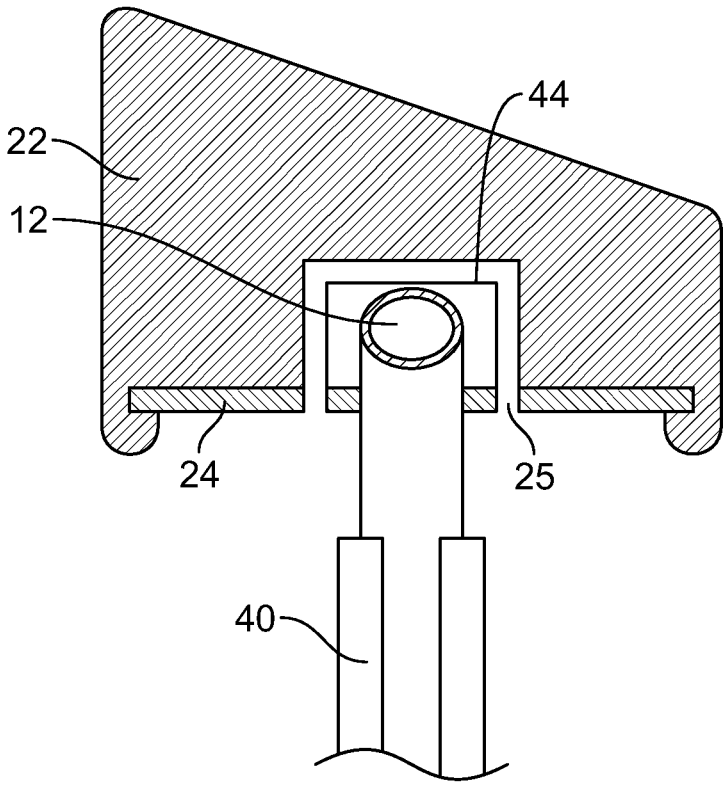
FIG. 6 is a section through a connection arrangement for a coolant tube according to a further embodiment of the invention.

Alternatively, the pipe section can be connected to a crimped anode such as those shown in FIGS. 2 and 3 from outside of the anode 1. Referring to FIG. 6, a gap 25 is cut into the rigid backbone 24. The right angle pipe sections 44 extend through the gap 25 in the rigid backbone 24 and are brazed at one end onto the coolant tube 12. On the external side of the rigid backbone 24 the right angle pipe sections 44 are welded onto ceramic breaks 40, which are connected to external cooling circuits, for example as in FIG. 5.

We claim:

1. An anode for an X-ray tube prepared by a process comprising the steps of:

obtaining at least one thermally conductive anode segment having a top surface and having a first side wall extending out from, and longitudinally along, the top surface and a second side wall opposing the first side wall and extending out from, and longitudinally along, the top surface wherein the at least one thermally conductive anode segment comprises a plurality of thermally conductive anode segments aligned end to end;

placing a rigid support member on the top surface of the at least one thermally conductive anode segment and between the first side wall and the second side wall, wherein each anode segment of the plurality of thermally conductive anode segments is in contact with the rigid support member;

securing the rigid support member to the at least one thermally conductive anode segment between the first side wall and the second side wall; and arranging a coolant tube between the rigid support member and the at least one thermally conductive anode segment to cool the at least one thermally conductive anode segment.

2. An anode according to claim 1, wherein the coolant tube comprises a cooling conduit arranged to carry coolant through the at least one thermally conductive anode segment.

3. An anode according to claim 2, wherein the cooling conduit is at least partially cut into the at least one thermally conductive anode segment.

4. An anode according to claim 2, wherein the cooling conduit is at least partially cut into the rigid support member.

5. An anode according to claim 2, wherein the cooling conduit has a curved cross-section.

6. An anode according to claim 2, wherein the coolant tube is an annealed copper tube.

7. An anode according to claim 1, wherein each anode segment of said plurality of thermally conductive anode segments is coated with a target metal.

8. An anode according to claim 7, wherein the target metal is applied as a thin film.

9. An anode according to claim 7, wherein the target metal is a metal foil.

10. An anode according to claim 9, wherein the metal foil has a thickness of between 50 microns and 500 microns.

11. An anode according to claim 7, wherein the target metal is applied to a front face of each anode segment of said plurality of thermally conductive anode segments.

12. An anode according to claim 7, wherein the target metal comprises at least one of tungsten, molybdenum, uranium and silver.

13. An anode according claim 1 , wherein each anode segment of said plurality of thermally conductive anode segments is made of copper.

14. An anode according to claim 1, wherein the rigid support member is made of stainless steel.

15. An anode according to claim 1, further comprising arranging an insulated pipe section to feed cooling fluid into the coolant tube.

16. An anode according to claim 15, wherein the insulated pipe section comprises a ceramic tube connected to the coolant tube; and a connector plate attached to one end of said ceramic tube.

* * * * *